US008177499B2

(12) United States Patent
Iida

(10) Patent No.: US 8,177,499 B2
(45) Date of Patent: May 15, 2012

(54) TURBINE BLADE CASCADE END WALL

(75) Inventor: Koichiro Iida, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 911 days.

(21) Appl. No.: 12/223,792

(22) PCT Filed: Jan. 30, 2007

(86) PCT No.: PCT/JP2007/051435

§ 371 (c)(1),
(2), (4) Date: Aug. 8, 2008

(87) PCT Pub. No.: WO2007/108232

PCT Pub. Date: Sep. 27, 2007

(65) Prior Publication Data

US 2009/0053066 A1 Feb. 26, 2009

(30) Foreign Application Priority Data

Mar. 16, 2006 (JP) ..... 2006-072250

(51) Int. Cl.
*F01D 1/02* (2006.01)

(52) U.S. Cl. ..... 415/208.1; 416/223 R

(58) Field of Classification Search ..... 415/208.1, 415/208.2, 191, 914; 416/193 A, 234, 248
See application file for complete search history.

(56) References Cited

U.S. PATENT DOCUMENTS

| | | | | |
|---|---|---|---|---|
| 6,079,948 | A * | 6/2000 | Sasaki et al. | 416/237 |
| 6,283,713 | B1 | 9/2001 | Harvey et al. | |
| 6,561,761 | B1 | 5/2003 | Decker et al. | |
| 6,669,445 | B2 | 12/2003 | Staubach et al. | |
| 7,134,842 | B2 | 11/2006 | Tam et al. | |
| 2003/0170124 | A1 | 9/2003 | Staubach et al. | |

FOREIGN PATENT DOCUMENTS

| | | | |
|---|---|---|---|
| EP | 1712737 | A1 | 10/2006 |
| JP | 2001-271792 | A | 10/2001 |
| JP | 2003-269384 | A | 9/2003 |
| JP | 2004-28065 | A | 1/2004 |

(Continued)

OTHER PUBLICATIONS

European Search Report dated Mar. 18, 2011, issued in corresponding European Patent Application No. 07707666.9.

(Continued)

*Primary Examiner* — Ross Gushi
(74) *Attorney, Agent, or Firm* — Westerman, Hattori, Daniels & Adrian, LLP

(57) ABSTRACT

In the turbine blades set to a large outflow angle, the performance of the entire turbine is improved by reducing a cross flow generated on the turbine end wall and a whirling up of flow on the suction side of a blade irrespective of the difference of the blade shape, thereby reducing the loss. There is provided a turbine blade cascade end wall positioned on the hub-side and/or the tip side of a plurality of turbine blades arranged in an annular shape, including a first projection having a ridge extending downward from the trailing edge of a turbine blade toward the downstream side gently at the beginning and steeply at the end, and along the suction side of an adjacent turbine blade.

4 Claims, 8 Drawing Sheets

FOREIGN PATENT DOCUMENTS

JP 2006-291889 A 10/2006

OTHER PUBLICATIONS

G. Brennan et al; "Improving the Efficiency of the Trent 500 HP Turbine Using Non-Axisymmetric End Walls: Part I Turbine Design," Proceedings of ASME Turbo Expo 2001; Jun. 4-7, 2001; New Orleans, Louisiana, USA; 2001-GT-0444; pp. 1-9.

International Search Report of PCT/JP2007/051435; date of mailing Apr. 24, 2007.

* cited by examiner

TURBINE BLADE CASCADE END WALL

TECHNICAL FIELD

The present invention relates to a turbine blade cascade end wall.

BACKGROUND ART

A turbine is known as a power generating device for obtaining a power by converting a kinetic energy of a fluid into a rotational movement. On a turbine blade cascade end wall of the turbine, a so-called "cross flow (secondary flow)" is generated from the pressure side of one turbine blade toward the suction side of the adjacent turbine blade.

In order to achieve the improvement of the turbine performance, it is necessary to reduce the cross flow and to reduce a secondary flow loss generated in association with the cross flow.

In the turbine which converts the kinetic energy of the fluid into the rotational movement, there is a trend to set the circumferential velocity of rotation of the turbine to a value higher than that in the related art to improve the performance of the entire turbine. In association with it, setting the outflow angle of blades to a larger angle in comparison with that in the related art is required. On the other hand, the secondary flow loss in association with the cross flow generally tends to increase with the increase of the outflow angle of the blades.

In order to reduce the secondary flow loss in association with the cross flow to improve the turbine performance, a configuration having recesses and projections formed on the turbine blade cascade end wall in nonaxisymmetry is known (for example, see Patent Citation 1).

In the turbine blades which generate a shock wave, for weakening the shock wave and improving the turbine performance, a configuration having a concave shaped end wall near the turbine throat is known (for example, see Patent Citation 2).

Patent Citation 1: Specification of U.S. Pat. No. 6,283,713

Patent Citation 2: Specification of U.S. Pat. No. 6,669,445

DISCLOSURE OF INVENTION

As described above, the blades set to a large outflow angle have a specific problem such that the secondary flow loss in association with the cross flow further increases. The effect of the nonaxisymmetric shape formed on the turbine blade cascade end wall disclosed in Patent Citation 1 does not solve the problem specific for the blades set to a large outflow angle, but the effects may vary depending on the blade shape. Therefore, resolution of the problem specific for the blades set to a large outflow angle is required.

According to the technology in the related art, a phenomenon such that the pressure in a area immediately downstream of the trailing edge of the blade (a portion in FIG. 7 surrounded by a broken line and a portion in FIG. 8 surrounded by a broken line) rises higher than the surrounding area due to stagnation of flow appears. The flow in the vicinity of the end wall passes through the area immediately downstream of the trailing edge of the blade when flowing out from the blade. As described above, when the pressure in the area rises, the flow in the vicinity of the end wall is hindered, and the cross flow and whirling up of flow on the suction side of the blade is accelerated, so that increase in loss is resulted.

In the case of the blades set to a large outflow angle, since the angle of flow is increased, the percentage of the flow passing through the area immediately downstream of the trailing edge of the blade is increased. Therefore, there is a specific problem such that the effect to hinder the flow due to the pressure increase in the corresponding area is increased and, in particular, the cross flow and the whirling up of flow on the suction side of the blade is further accelerated and, in particular, the increase in loss is increased.

On the turbine blade cascade end wall disclosed in Patent Citation 2, there is provided a projection having a ridge extending downward from the trailing edge of the turbine blade toward the downstream side at a regular rate and then along the suction side of the adjacent turbine blade by providing a maximum height difference distribution in the circumferential shape of the end wall at the position of a throat.

As an effect of Patent Citation 2, reduction of loss by reduction of a shock wave is intended. The shock wave only occurs at the blades under limited operating conditions and at the limited blades, and the phenomenon is completely different from the secondary flow loss in association with the cross flow. In the present invention, the problem of increase in the secondary flow loss in association with the cross flow in the blades set to a large outflow angle is solved.

In view of such circumstances, it is an object of the present invention to provide a turbine blade cascade end wall in which a cross flow generated on the turbine blade cascade end wall is reduced and excessive whirling up of flow generated on the suction side of the turbine having a corresponding blade cascade is restrained so that an effect of improved performance of the entire turbine having a plurality of blade cascades is achieved. In particular, according to the present invention, specifically extensive improvement effect is obtained for the blades set to a large outflow angle. Also, according to the present invention, the effect is achieved irrespective of the blade shape for the blades set to a large outflow angle.

In order to solve the above-described problem, the following solutions are employed.

The turbine blade cascade end wall according to a first aspect of the present invention is a turbine blade cascade end wall positioned on the hub-side and/or the tip side of a plurality of turbine blades arranged in an annular shape, including a first projection having a ridge extending downward from the trailing edge of the turbine blade toward the downstream side gently at the beginning and steeply at the end, and along the suction side of an adjacent turbine blade.

According to the turbine blade cascade end wall as described above, a static pressure in the vicinity of a first projection located immediately downstream of the trailing edge of the blade as shown in FIG. 7 decreases by the effect of the first projection which is different from, so-called, "fillet" or "rounded" (see a portion surrounded by a broken line in FIG. 7).

With the shape in the related art, in the area immediately downstream of the trailing edge of the blade (the area where the first projection is located), there is a phenomenon such that the static pressure rises higher than the surrounding area due to the stagnation of flow. If the static pressure in this area rises when the flow in the vicinity of the end wall directed circumferentially by the cross flow passes through the area immediately downstream of the trailing edge (the area where the first projection is located), the flow is hindered, and hence the cross flow and the whirling up of flow to the suction side of the blade are accelerated, so that the loss is increased. Since the first projection has an effect to restrain the phenomenon of increase in static pressure in the area immediately downstream of the trailing edge of the blade (to decrease the static pressure more than in the related art), a smoother flow than those in the related art is achieved when the flow in the vicinity of the end wall passes through the area immediately downstream of the trailing edge (where the first projection is located), so that restraint of increase in loss is achieved.

In the case of the blades set to a large outflow angle, since the percentage of passage of the flow in the vicinity of the end wall in the area immediately downstream of the trailing edge of the blade is high, the loss improvement effect as described above is specifically effective and, from the physical phenomenon described above, the effect is achieved irrespective of the blade shape in the case of the blades set to a large outflow angle.

Preferably, the turbine blade cascade end wall according to the present invention is provided between one turbine blade and another turbine blade arranged adjacently to the one turbine blade with a second projection swelled gently toward the suction side of the one turbine blade in the range from about 0% Cax to about 20% Cax and a third projection swelled gently toward the pressure side of another turbine in the range from about 0% Cax to about 20% Cax, where 0% Cax is the position of the leading edge of the turbine blade in the axial direction, 100% Cax is the position of the trailing edge of the turbine blade in the axial direction, 0% pitch is the position of the pressure side of the turbine blade and 100% pitch is the position of the suction side of the turbine blade which opposes the pressure side of the turbine blade.

According to the turbine blade cascade end wall as describe above, the static pressure in the vicinity of the second projection and the third projection may decrease, whereby the pressure gradient on the upstream side of the throat may be directed to the direction along the suction side of the one turbine blade and the pressure side of the other turbine blade and a working fluid may be caused to flow along the suction side of the one turbine blade and the pressure side of the other turbine blade. Therefore, the cross flow may be reduced and the secondary flow loss in association with the cross flow is reduced by using the turbine blade cascade end wall, so that the turbine performance is improved.

Further preferably, the turbine blade cascade end wall described above is provided with a recess depressed gently from the suction side of the one turbine blade and the pressure side of another turbine blade toward the position of about 50% Cax and about 50% pitch.

According to the turbine blade cascade end wall as described above, the static pressure in the vicinity of the recess may rise, whereby the pressure gradient on the upstream side of the throat may be directed to the direction along the suction side of the one turbine blade and the pressure side of the other turbine blade and a working fluid may be caused to flow along the suction side of the one turbine blade and the pressure side of the other turbine blade. Therefore, the cross flow may be reduced and the secondary flow loss in association with the cross flow is reduced by using the turbine blade cascade end wall, so that the turbine performance is improved.

The turbine according to a second aspect of the present invention is provided with a turbine blade cascade end wall in which the cross flow generated on the turbine blade cascade end wall is reduced, and the excessive whirling up of flow generated on the suction side of the turbine blade is restrained.

According to the turbine as described above, increase in secondary flow loss in association with the cross flow and the secondary flow loss generated in association with the whirling up of flow (secondary flow on the suction side) is restrained, so that the improvement of the performance of the entire turbine having a plurality of blade cascades is achieved. In particular, the effect is significant for the blades set to a large outflow angle, and the same effect is obtained in the blades set to a large outflow angle irrespective of the blade shape.

According to the second aspect of the present invention, the turbine blade cascade end wall in which the cross flow generated on the turbine blade cascade end wall may be reduced, and the excessive whirling up of flow generated on the suction side of the turbine blade may be restrained, is provided, and the effect of improving the performance of the entire turbine having a plurality of blade cascades is achieved. In particular, the effect is extensive in the blades set to a large outflow angle, and the same effect is achieved for the blades set to a large outflow angle irrespective of the blade shape.

EXPLANATION OF REFERENCE

Figure 1:
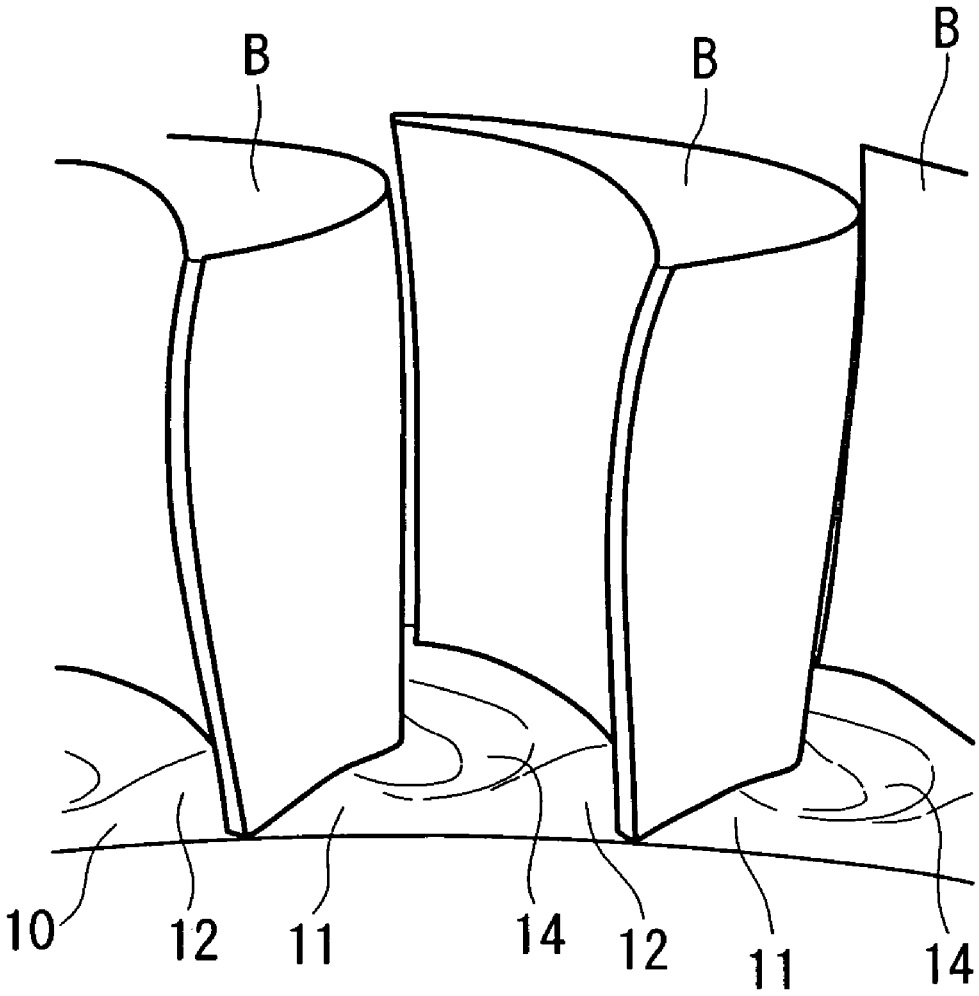
FIG. 1 is a drawing showing an embodiment of a turbine blade cascade end wall according to the present invention, and is a schematic perspective view of the turbine blade viewed from the leading edge side thereof.

10: hub end wall (turbine blade cascade end wall)
11: first projection (second projection)
12: second projection (third projection)
13: third projection (first projection)
14: recess
B: turbine blade

BEST MODE FOR CARRYING OUT THE INVENTION

Referring now to the drawings, an embodiment of a turbine blade cascade end wall in the present invention will be described.

Figure 2:
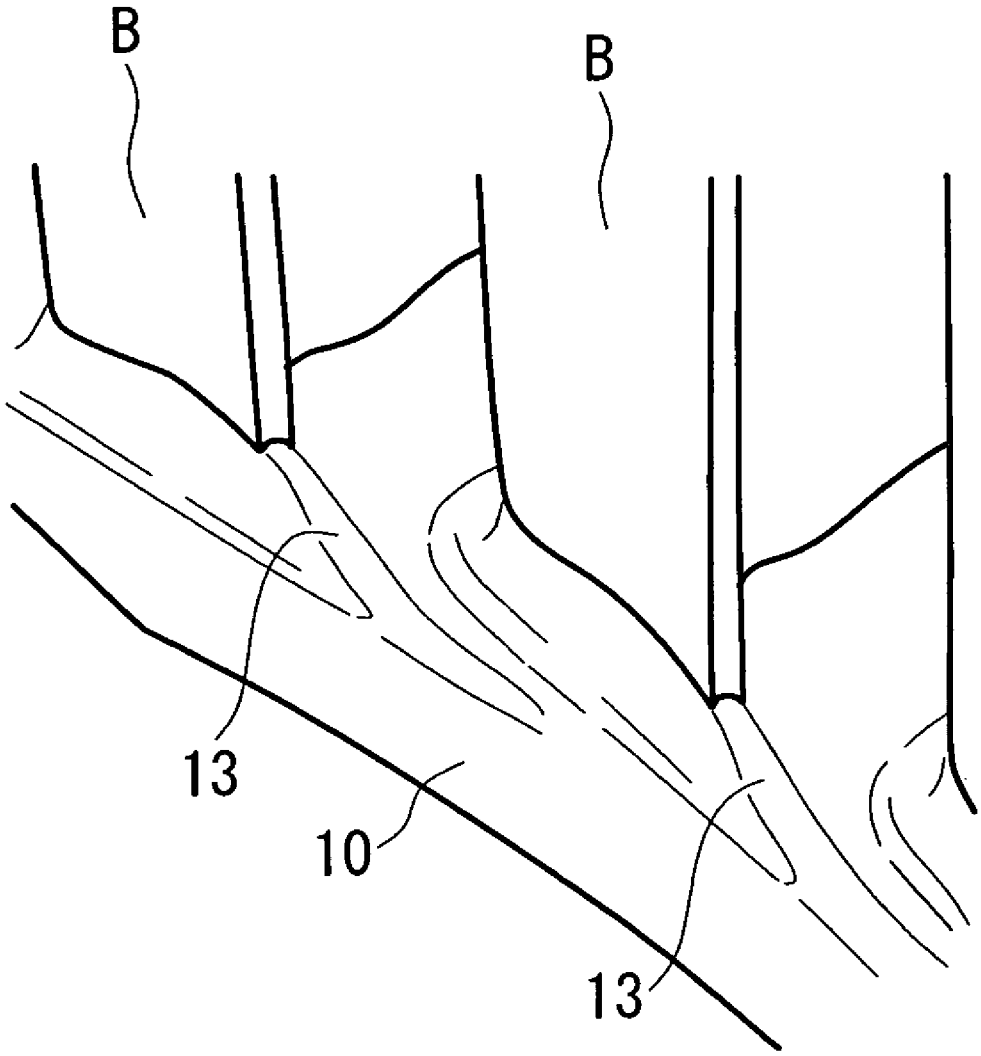
FIG. 2 is a schematic perspective view of the turbine blade cascade end wall shown in FIG. 1 viewed from the trailing edge side of the turbine blade.
Figure 3:
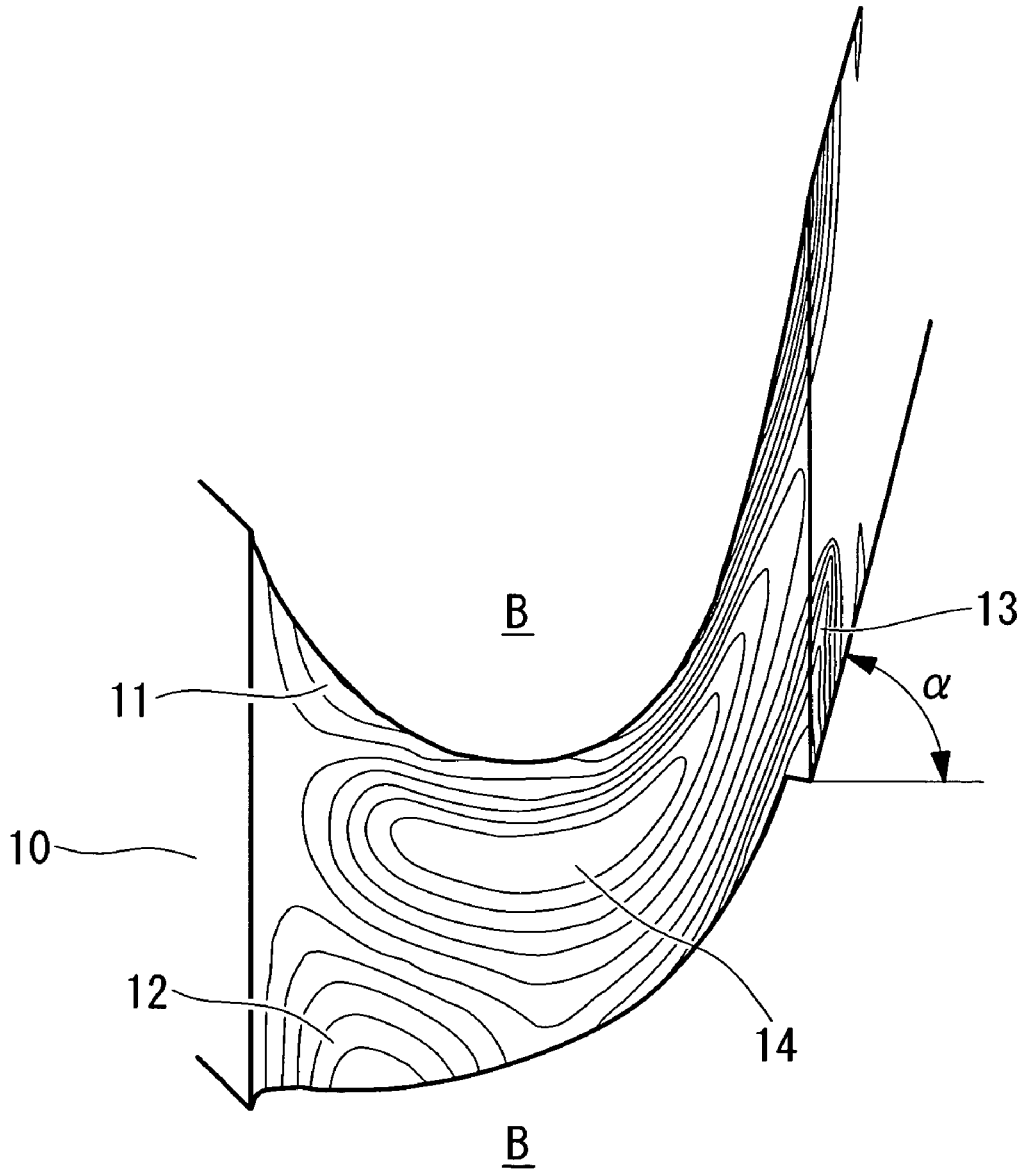
FIG. 3 is a plan view of a principal portion of the turbine blade cascade end wall shown in FIG. 1.

As shown in FIG. 1 to FIG. 3, a turbine blade cascade end wall (hereinafter, referred to as "hub end wall") 10 in this embodiment is arranged between one turbine blade (turbine rotor blade in this embodiment) B and a turbine blade B arranged in adjacent to the turbine blade B (hereinafter, referred to as "another turbine blade B"), having a first projection (second projection) 11, a second projection (third projection) 12, a third projection (first projection) 13 and a recess 14 provided thereon. Thin solid lines shown on the hub end wall 10 in FIG. 3 are contour lines.

As shown in FIG. 1 and FIG. 3, the first projection 11 is a portion swelled gently (smoothly) in the range from about 0% Cax to about 20% Cax toward the suction side of the one turbine blade B.

The second projection 12 is a portion swelled gently (smoothly) in the range from about 0% Cax to about 20% Cax toward the pressure side of the one turbine blade B.

As shown in FIG. 2 and FIG. 3, the third projection 13 has a ridge extending downward from the trailing edge of the turbine blade B toward the downstream side gently at the beginning and steeply at the end, and along the suction side of an adjacent turbine blade. The third projection 13 is different from, so-called, "fillet" or "rounded".

The recess 14 is a portion depressed gently (smoothly) from the suction side of the one turbine blade B and the pressure side of another turbine blade B toward the position of about 50% Cax and about 50% pitch, that is, a recessed portion having a peak of depression at the position of about 50% Cax and about 50% pitch.

The value 0% Cax here is the position of the leading edge of the turbine blade B in the axial direction, the value 100% Cax is the position of the trailing edge of the turbine blade B in the axial direction. The value 0% pitch is the position of the pressure side of the turbine blade B and the value 100% pitch is the position of the suction side of the turbine blade B.

A reference sign $\alpha$ in FIG. 3 is an outflow angle and, in this embodiment, it is set to be 60 degrees or larger (more preferably, 70 degrees or larger).

Figure 4:
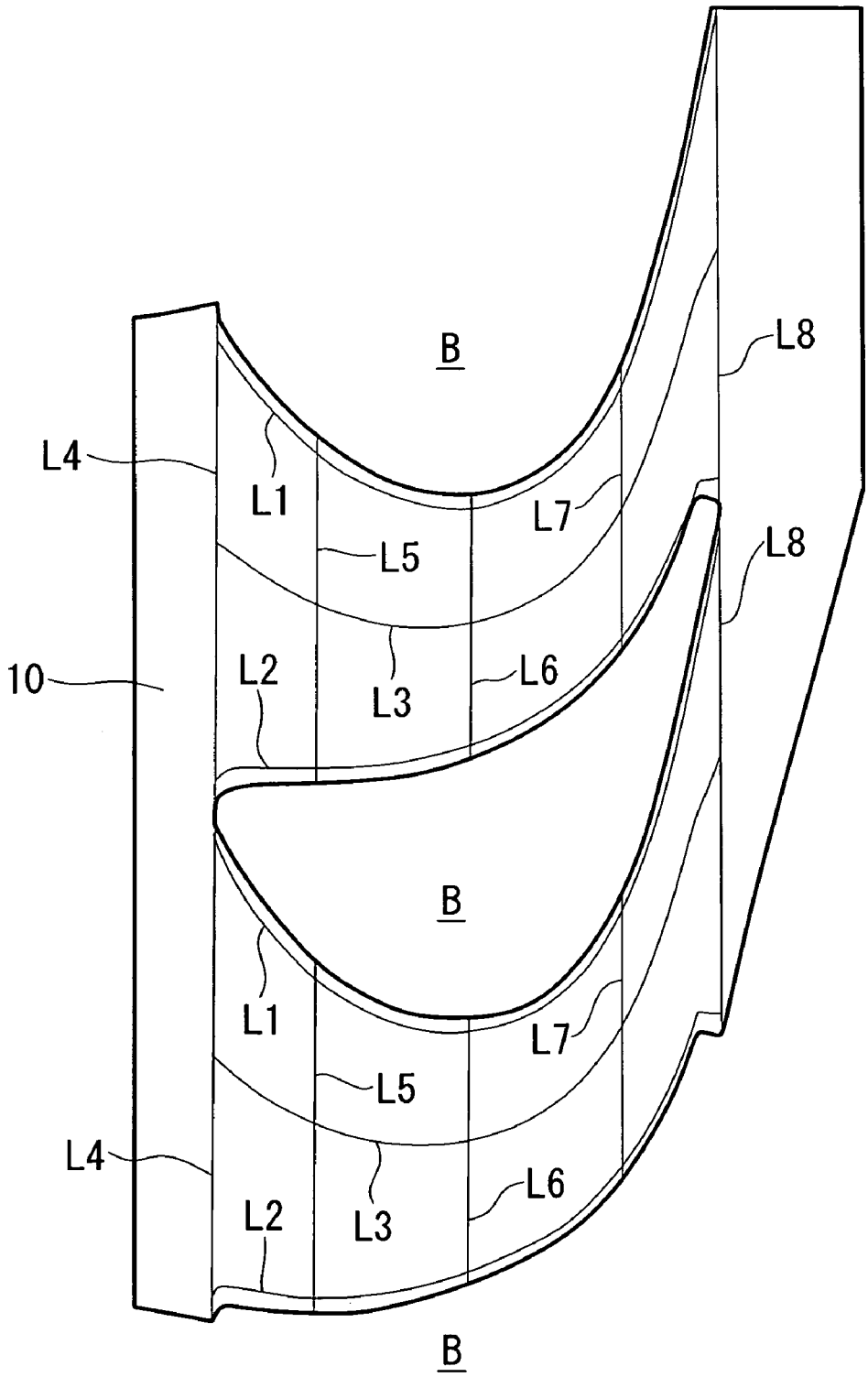
FIG. 4 is a plan view of a principal portion of the turbine blade cascade end wall like in FIG. 3.
Figure 5:
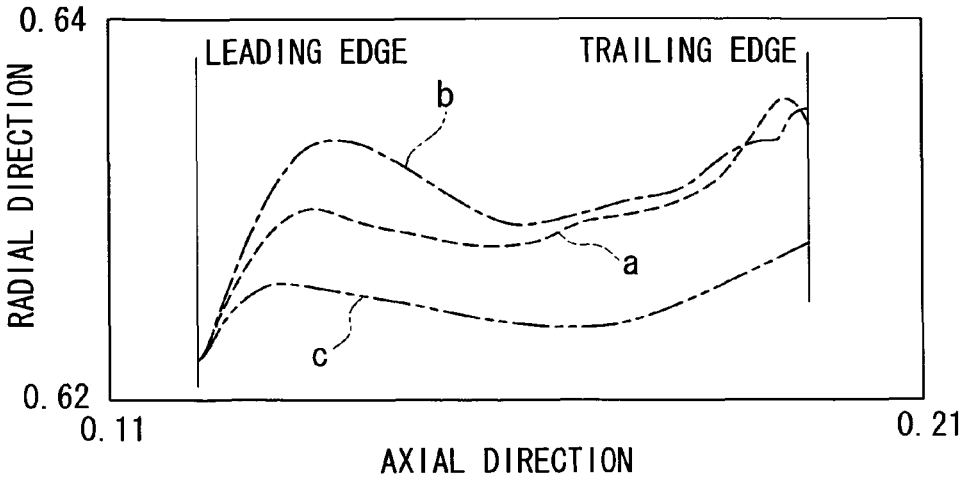
FIG. 5 is a graph showing up and down (recesses and projections) of the turbine blade cascade end wall located between one turbine blade and another turbine blade.
Figure 6:
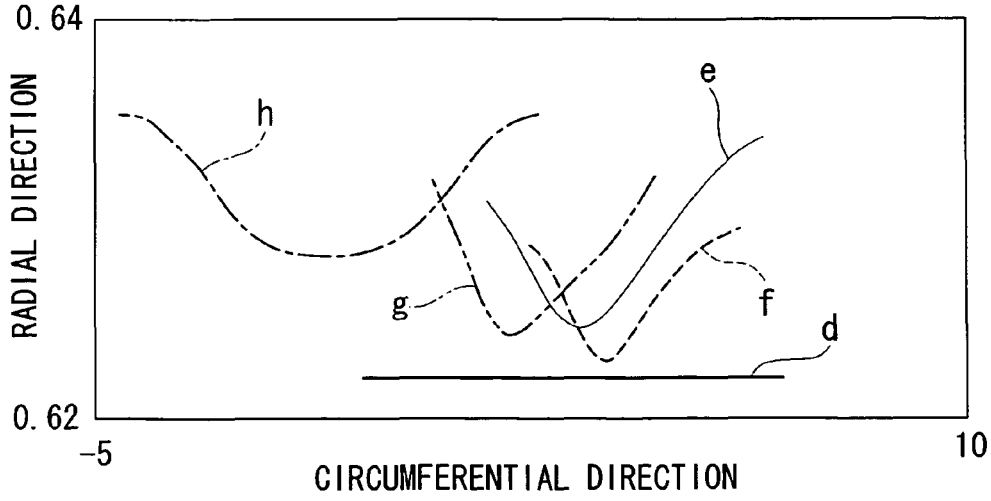
FIG. 6 is a graph showing the up and down (recesses and projections) of the turbine blade cascade end wall located between one turbine blade and another turbine blade.

Referring now to FIG. 4 to FIG. 6, the shapes of the first projection 11, the second projection 12, the third projection 13 and the recess 14 are described in more detail.

FIG. 4 is a plan view of the principal portion of the hub end wall 10 like in FIG. 3. Thin solid lines L1 shown in FIG. 4 are lines drawn in the vicinity of the suction side of the turbine blade B and along the suction side of the turbine blade B, that is, lines drawn at about 95% pitches in the range from 0% Cax to 100% Cax.

Thin solid lines L2 shown in FIG. 4 are lines drawn in the vicinity of the pressure side of the turbine blade B and along the pressure side of the turbine blade B, that is, lines drawn at about 5% pitches in the range from 0% Cax to 100% Cax.

Thin solid lines L3 shown in FIG. 4 are lines drawn at the intermediate position between the solid lines L1 and the solid lines L2, that is, lines drawn at about 50% pitches in the range from 0% Cax to 100% Cax.

Thin solid lines L4 shown in FIG. 4 are lines extending in parallel to the surface orthogonal to the axial direction (line of axis of rotation) of the turbine blade B and are lines drawn at positions 0% Cax in the range from 0% pitch to 100% pitches.

Thin solid lines L5 in FIG. 4 are lines extending in parallel to the surface orthogonal to the axial direction of the turbine blade B and are lines drawn at positions about 20% Cax in the range from 0% pitch to 100% pitches.

Thin solid lines L6 in FIG. 4 are lines extending in parallel to the surface orthogonal to the axial direction of the turbine blade B and are lines drawn at positions about 50% Cax in the range from 0% pitch to 100% pitches.

Thin solid lines L7 in FIG. 4 are lines extending in parallel to the surface orthogonal to the axial direction of the turbine blade B and are lines drawn at positions about 80% Cax in the range from 0% pitch to 100% pitches.

Thin solid lines L8 in FIG. 4 are lines in parallel to the surface orthogonal to the axial direction of the turbine blade B and are lines drawn at positions 100% Cax in the range from 0% pitch to 100% pitches.

FIG. 5 and FIG. 6 are graphs showing up and down (recesses and projections) of the hub end wall 10 positioned between the one turbine blade B and another turbine blade B. A broken line a shown in FIG. 5 indicates the up and down of the hub end wall 10 seen when moving from the leading edge to the trailing edge of the turbine blade B along the thin solid line L1 shown in FIG. 4.

A dashed line b shown in FIG. 5 indicates the up and down of the hub end wall 10 seen when moving from the leading edge to the trailing edge of the turbine blade B along the thin solid line L2 shown in FIG. 4.

A dashed line c shown in FIG. 5 indicates the up and down of the hub end wall 10 seen when moving from the leading edge to the trailing edge of the turbine blade B along the thin solid line L3 shown in FIG. 4.

On the other hand, a thick solid line d shown in FIG. 6 indicates the up and down of the hub end wall 10 seen when moving from the suction side (or the pressure side) of the one turbine blade B to the pressure side (or the suction side) of another turbine blade B along the thin solid line L4 shown in FIG. 4.

A thin solid line e shown in FIG. 6 indicates the up and down of the hub end wall 10 seen when moving from the suction side (or the pressure side) of the one turbine blade B to the pressure side (or the suction side) of another turbine blade B along the thin solid line L5 shown in FIG. 4.

A thin solid line f shown in FIG. 6 indicates the up and down of the hub end wall 10 seen when moving from the suction side (or the pressure side) of the one turbine blade B to the pressure side (or the suction side) of another turbine blade B along the thin solid line L6 shown in FIG. 4.

A thin solid line g shown in FIG. 6 indicates the up and down of the hub end wall 10 seen when moving from the suction side (or the pressure side) of the one turbine blade B to the pressure side (or the suction side) of another turbine blade B along the thin solid line L7 shown in FIG. 4.

A thin solid line h shown in FIG. 6 indicates the up and down of the hub end wall 10 seen when moving from the suction side (or the pressure side) of the one turbine blade B to the pressure side (or the suction side) of another turbine blade B along the thin solid line L8 shown in FIG. 4.

As will be understood from FIG. 5 and FIG. 6, the apex of the first projection 11 is located at a level lower than the apex of the second projection 12. In other words, the apex of the second projection 12 is located at a level higher than the apex of the first projection 11.

The intermediate position between the one turbine blade B and another turbine blade B is located at a level lower than the root portion of the suction side of the one turbine blade B and the root portion of the pressure side of another turbine blade B in the range from 0% Cax to 100% Cax.

Also, as will be understood from the broken line a and the dashed line b in FIG. 5, the apex of the third projection 13 (that is, the highest point of the ridge) is located at (in the vicinity of) the tailing edge end of the turbine blade B.

Figure 7:
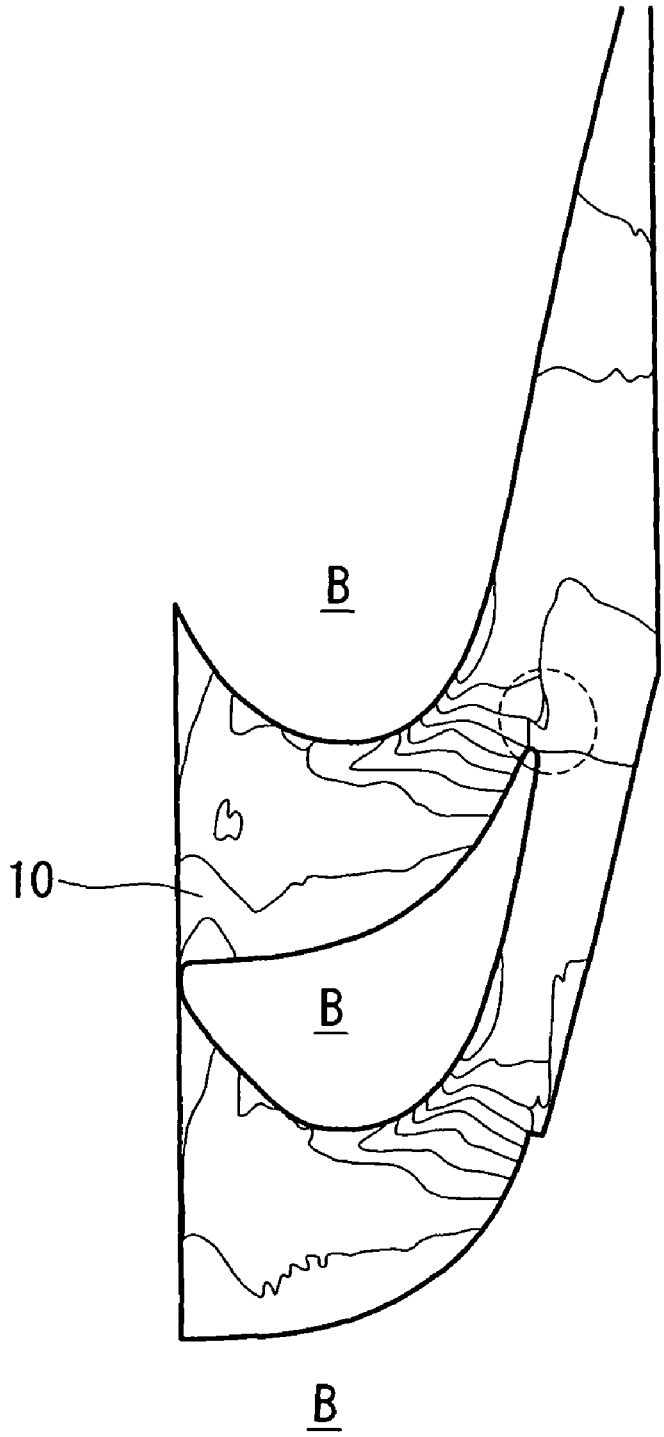
FIG. 7 is a drawing showing a static pressure distribution on the surface of the turbine blade cascade end wall.
Figure 8:
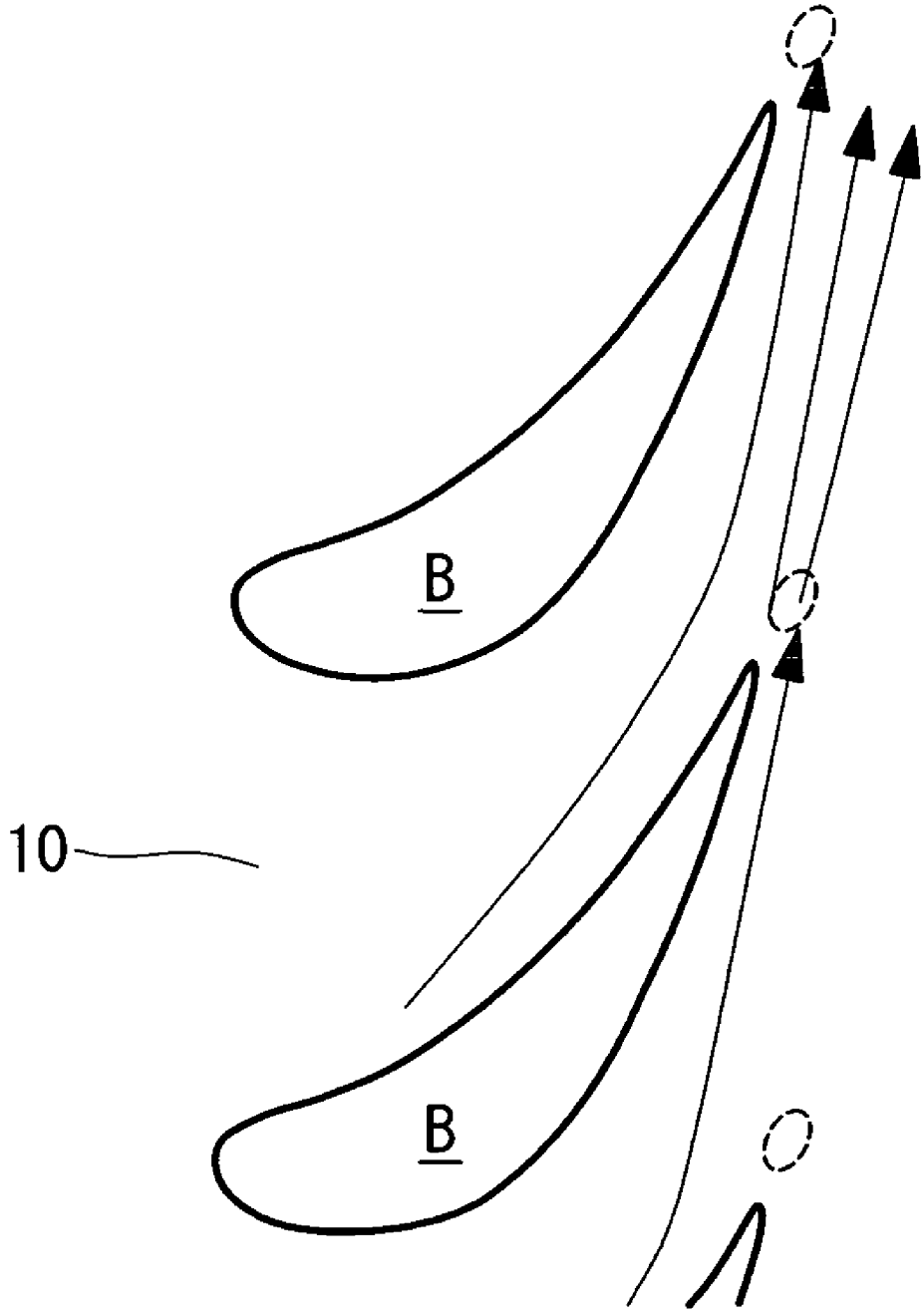
FIG. 8 is a drawing showing a flow of a working fluid on the surface of the turbine blade cascade end wall.

According to the hub end wall 10 in this embodiment, the static pressure in the vicinity of the third projection 13 may decrease (see the portion surrounded by a broken line in FIG. 7 and the portion surrounded by a broken line in FIG. 8) as shown in FIG. 7.

Accordingly, increase in static pressure due to the stagnation of flow in the area immediately downstream of the trailing edge of the blade (the area where the third projection 13 is located) is restrained, and the flow in the vicinity of the end wall directed circumferentially due to the cross flow is hindered when passing through the area immediately downstream of the trailing edge (the area where the third projection 13 is located), so that the acceleration of the cross flow and the whirling up of flow on the suction side are restrained. Therefore, increase in loss is restrained.

In the blades set to a large outflow angle, since the percentage of the flow passing through the area immediately downstream of the trailing edge of the blade in the vicinity of the end wall is increased, the loss improvement effect as described above is specifically extensive.

In addition, from the reasons shown above, in the blades set to a large outflow angle, the same effect is achieved irrespective of the blade shape.

Here, the blades set to a large outflow angle are those having an outflow angle $\alpha$ is 60 degrees or larger (more preferably, 70 degrees or larger).

Also, in the blades set to a large outflow angle, since the space on the axially downstream side of the trailing edge of the blade required for providing the third projection 13 may be small, they are at lower risk of need of extension of the end on the downstream side of the hub end wall 10 (on the axially downstream side).

On the other hand, by the provision of the first projection 11, the second projection 12, and the recess 14, the static pressure in the vicinity of the first projection 11 and in the vicinity of the second projection 12 decreases as shown in FIG. 7, whereby the static pressure in the vicinity of the recess 14 may rise. Accordingly, the pressure gradient on the upstream side of the throat may be directed to the direction along the suction side of the one turbine blade B and the pressure side of another turbine blade B and a working fluid may be caused to flow along the suction side of the one turbine blade B and the pressure side of another turbine blade B. With the hub end wall 10 in the configuration shown above, the cross flow may be reduced and the secondary flow loss in association with the cross flow is reduced, so that the turbine performance is improved.

By decreasing the static pressure in the vicinity of the first projection 11 and in the vicinity of the second projection 12, low temperature gas (leaked air) from a leading edge upstream cavity is allowed to flow in a wider range (area) along the surface of the hub end wall 10, so that the cooling effect of the hub end wall 10 is improved.

Figure 9:
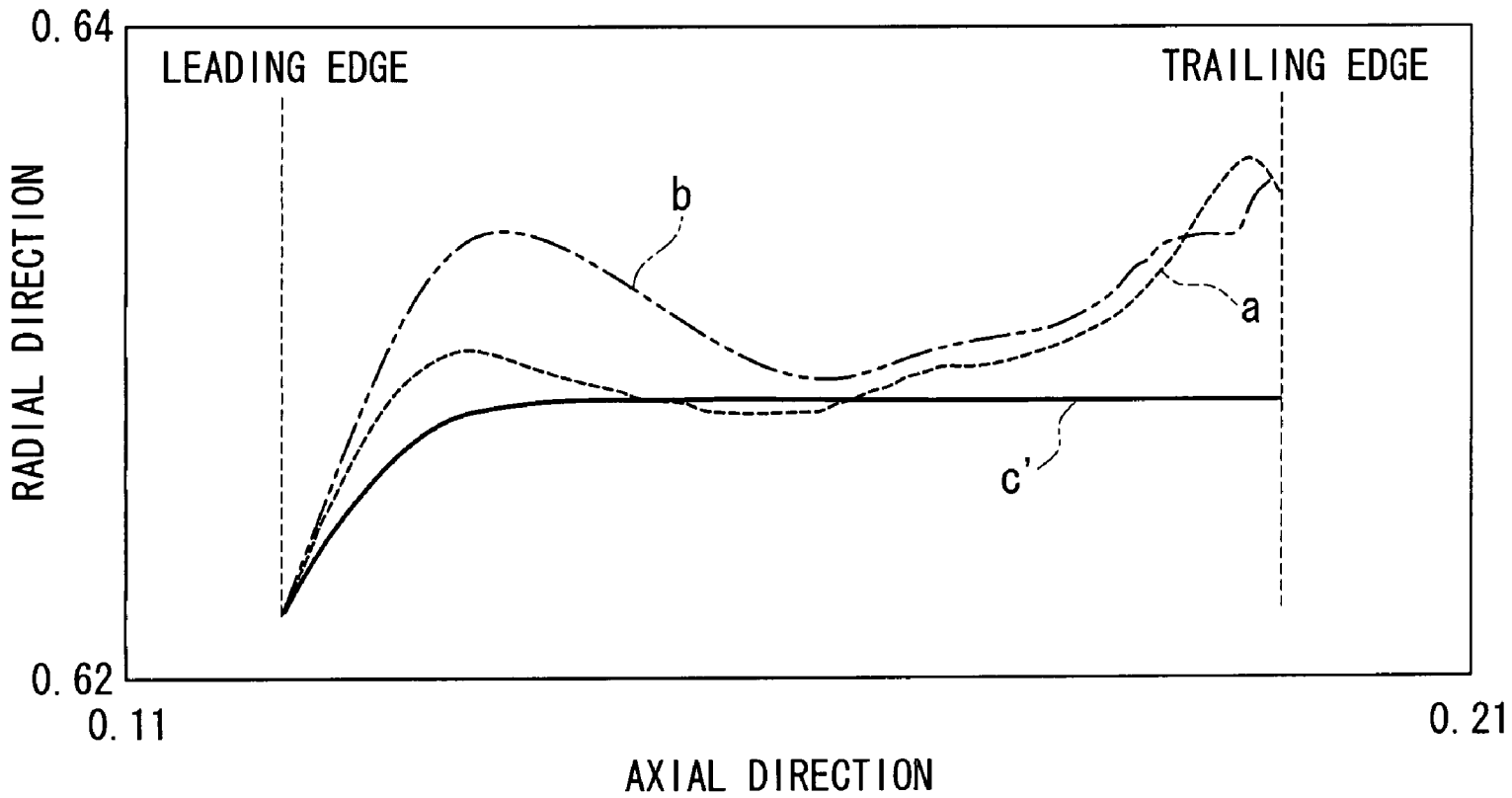
FIG. 9 is a graph showing the up and down (recesses and projections) of the turbine blade cascade end wall located between one turbine blade and another turbine blade according to another embodiment of the turbine blade cascade end wall in the present invention.

Referring now to FIG. 9, another embodiment of the hub end wall according to the present invention will be described.

The hub end wall according to this embodiment is different from the embodiment described above in that the hub end wall 10 seen when the hub end wall is moved from the leading edge to the trailing edge of the turbine blade B along the thin solid line L3 shown in FIG. 4 has up and down as shown in a solid line c' in FIG. 9. Other components are the same as the embodiment shown above, and hence description of those components will be omitted here.

The broken line a and the double dashed line b in FIG. 9 are the same as the broken line a and the double dashed line b in FIG. 4, respectively.

Since the effects and advantages are the same as those in the embodiment described above, the description will be omitted here.

In the embodiments described above, the hub end wall of the turbine rotor blade has been exemplified and described as the hub end wall. However, the present invention is not limited thereto, and the first projection 11, the second projection 12, the third projection 13 and the recess 14 may be provided on the hub end wall of the turbine stator blade or a tip end wall of the turbine rotor blade, or the tip end wall of the turbine stator blade.

The hub end wall according to the present invention may be applied both to gas turbines and steam turbines.

The invention claimed is:

1. A turbine blade cascade end wall positioned on the hub-side and/or the tip side of a plurality of turbine blades arranged in an annular shape, comprising:

a first projection of said turbine blade cascade end wall having a ridge extending in a manner such that a height of the ridge with respect to a radial direction decreases from the trailing edge of a turbine blade toward the downstream side gently at the beginning and steeply at the end, and along the suction side of an adjacent turbine blade.

2. The turbine blade cascade end wall according to claim 1, wherein the turbine blade cascade end wall is provided between one turbine blade and another turbine blade arranged adjacently to the one turbine blade with a second projection swelled gently toward the suction side of the one turbine blade in the range from about 0% Cax to about 20% Cax and a third projection swelled gently toward the pressure side of another turbine blade in the range from about 0% Cax to about 20%, where 0% Cax is the position of the leading edge of the turbine blade in the axial direction, 100% Cax is the position of the trailing edge of the turbine blade in the axial direction, 0% pitch is the position of the pressure side of the turbine blade and 100% pitch is the position of the suction side of the turbine blade which opposes the pressure side of the turbine blade.

3. The turbine blade cascade end wall according to claim 2, wherein the turbine blade cascade end wall is provided with a recess depressed gently from the suction side of the one turbine blade and the pressure side of another turbine blade toward the position of about 50% Cax and about 50% pitch.

4. A turbine comprising the turbine blade cascade end wall according to claim 1.

* * * * *